US011027173B2

(12) United States Patent
Lessans

(10) Patent No.: US 11,027,173 B2
(45) Date of Patent: Jun. 8, 2021

(54) POOL NOODLE, ASSEMBLY, AND METHOD OF USE

(71) Applicant: Jonathan R. Lessans, Charleston, SC (US)

(72) Inventor: Jonathan R. Lessans, Charleston, SC (US)

( * ) Notice: Subject to any disclaimer, the term of this patent is extended or adjusted under 35 U.S.C. 154(b) by 0 days.

(21) Appl. No.: 16/601,946

(22) Filed: Oct. 15, 2019

(65) Prior Publication Data

US 2020/0114208 A1 Apr. 16, 2020

Related U.S. Application Data

(60) Provisional application No. 62/746,060, filed on Oct. 16, 2018.

(51) Int. Cl.
*A63B 31/00* (2006.01)
*B63C 9/08* (2006.01)

(52) U.S. Cl.
CPC ..... *A63B 31/00* (2013.01); *B63C 9/08* (2013.01)

(58) Field of Classification Search
CPC .. B63B 7/00; B63B 7/02; B63B 35/00; B63B 35/74; B63B 35/76; B63C 9/00; B63C 9/08; B63C 9/081; B63C 9/135; A63B 31/00
USPC ..... 441/129
See application file for complete search history.

(56) References Cited

U.S. PATENT DOCUMENTS 6,056,613 A * 5/2000 Pike ..... B63C 9/135 441/129
6,132,276 A * 10/2000 Leemon ..... B63B 7/04 441/129
6,790,112 B2 * 9/2004 Kirk ..... B63B 34/50 441/129
D655,364 S * 3/2012 Johnston ..... D21/805
8,920,206 B1 * 12/2014 Bartow ..... B63B 34/00 441/129
9,039,473 B1 * 5/2015 Wachter ..... A63H 23/10 441/129
9,469,388 B2 * 10/2016 Olshan ..... B63C 9/081
2014/0290022 A1 * 10/2014 Gratch ..... B63B 34/00 441/129

* cited by examiner

*Primary Examiner* — Lars A Olson

(57) ABSTRACT

A water noodle system includes three water noodles and at least two water noodle straps. Each of the water noodles has an elongated body extending along a longitudinal axis and terminating at first and second ends. The elongated body defines a central bore therethrough that is axially aligned with the longitudinal axis, and an outer surface of the elongated body includes a plurality of protrusions extending therefrom and radially therearound. Each of the water noodle straps has an elongated strap body terminating at first and second ends, and first and second buckle portions affixed to the respective first and second ends of the elongated strap body. The first and second buckle portions are configured to mate with each other.

18 Claims, 6 Drawing Sheets

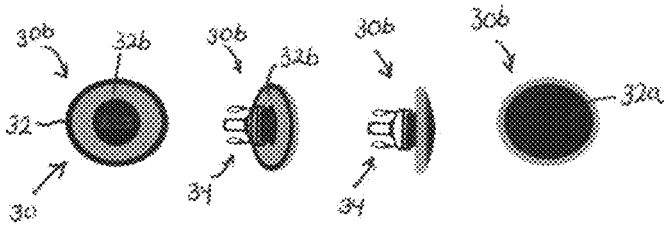
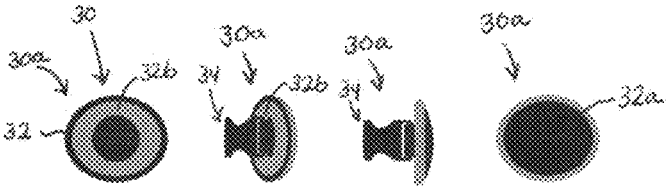
FIG. 6A FIG. 6B FIG. 6C FIG. 6D
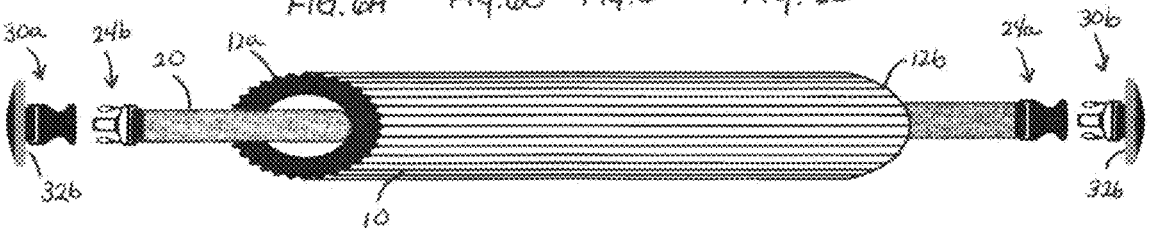
FIG. 7B
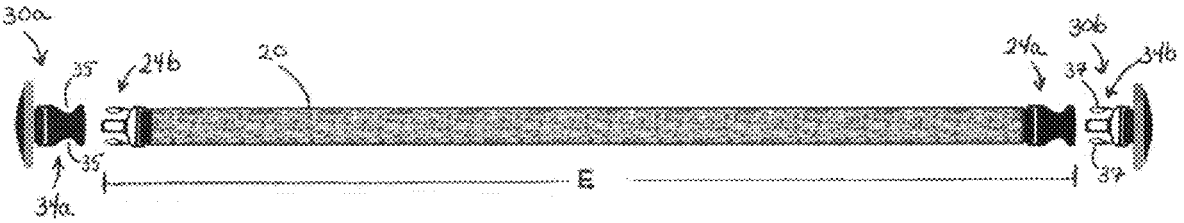
FIG. 7A

POOL NOODLE, ASSEMBLY, AND METHOD OF USE

CROSS-REFERENCE TO RELATED APPLICATIONS

This application claims the benefit of and priority to U.S. Provisional Patent Application No. 62/746,060, filed Oct. 16, 2018, the entire contents of which are incorporated herein by reference.

TECHNICAL FIELD

The present technology is generally related to floatation devices, and more particularly, to pool noodles and assemblies.

BACKGROUND

Floatation devices assist a user or object in keeping afloat in water. For example, a life saver is a floatation device having a ring shape that is sized to encircle a user and suspend the user's head above water. As another example, an inner tube is an inflatable floatation device having a ring shape that a user can lay across and have their back, arms, and legs supported. As yet another example, a pool noodle is a floatation device having an elongated shape that a user can straddle with their arms, torso, and/or legs to add buoyancy to the user's body.

SUMMARY

Pool noodles and assemblies of the present disclosure are arrangeable in a variety of configurations for use in water as recreational, utility, and/or safety devices.

In one aspect, the present disclosure provides a water noodle system including three water noodles and at least two water noodle straps. Each of the water noodles has an elongated body extending along a longitudinal axis and terminating at first and second ends. The elongated body defines a central bore therethrough that is axially aligned with the longitudinal axis, and an outer surface of the elongated body includes a plurality of protrusions extending therefrom and radially therearound. Each of the water noodle straps has an elongated strap body terminating at first and second ends, and first and second buckle portions affixed to the respective first and second ends of the elongated strap body. The first and second buckle portions are configured to mate with each other.

The first and second ends of each of the water noodles may be disposed at an angle with respect to the longitudinal axis of the elongated body. The angle of each of the first and second ends may be about 45 degrees.

The plurality of protrusions may extend longitudinally along an entire length of the elongated body in a uniform manner. Each of the plurality of protrusion may include side walls extending outwardly from the elongated body and converging at a point. Each of the water noodles may include thirty-two points.

Each of the water noodles includes an outer diameter defined by the outer surface of the elongated body and an inner diameter defined by an inner wall of the elongated body. A ratio of the inner diameter to the outer diameter may be about or greater than 0.7.

The water noodle straps may have different lengths. Each of the water noodle straps may include a strap adjuster.

The water noodle system may further include at least two water noodle caps. Each of the water noodle caps may include a cap body and a connector extending from an inner surface of the cap body. The connector may be configured to mate with the first or second buckle portion of the water noodle strap.

The water noodle caps may have an oval footprint.

The three water noodles may be bundled together with at least one of the water noodle straps secured around the outer surfaces of the water noodles to form a water noodle assembly. One of the water noodle straps may be passed through the central bore of one of the water noodles.

One of the water noodle straps may be passed through the central bore of each of the water noodles and the first and second buckle portions of the water noodle strap may be locked together to form a water noodle triangle.

In another aspect, the present disclosure provides a water noodle including an elongated body extending along a longitudinal axis and terminating at first and second ends. The elongated body defines a central bore therethrough that is axially aligned with the longitudinal axis, and an outer surface of the elongated body includes a plurality of protrusions extending therefrom and radially therearound. The water noodle is fabricated from a closed cell foam.

The first and second ends of the water noodle may be disposed at an angle with respect to the longitudinal axis of the elongated body.

The plurality of protrusions may extend longitudinally along an entire length of the elongated body in a uniform manner. Each of the plurality of protrusion may include side walls extending outwardly from the elongated body and converging at a point.

The details of one or more aspects of the disclosure are set forth in the accompanying drawings and the description below. Other aspects, features, and advantages will be apparent from the description and drawings, and from the claims.

BRIEF DESCRIPTION OF DRAWINGS

FIGS. 6A-6D are bottom, perspective, side, and top views, respectively, of caps for use with the water noodle straps of the water noodle system of FIG. 2 in accordance with an embodiment of the present disclosure;

FIG. 7A is a side view of a water noodle strap and the caps of FIGS. 6A-6D in accordance with an embodiment of the present disclosure; and FIG. 7B is a side view of the water noodle strap and the caps of FIG. 7A shown with the water noodle strap extending through the water noodle of FIGS. 1A and 1B in accordance with an embodiment of the present disclosure.

DETAILED DESCRIPTION

Figure 1A:
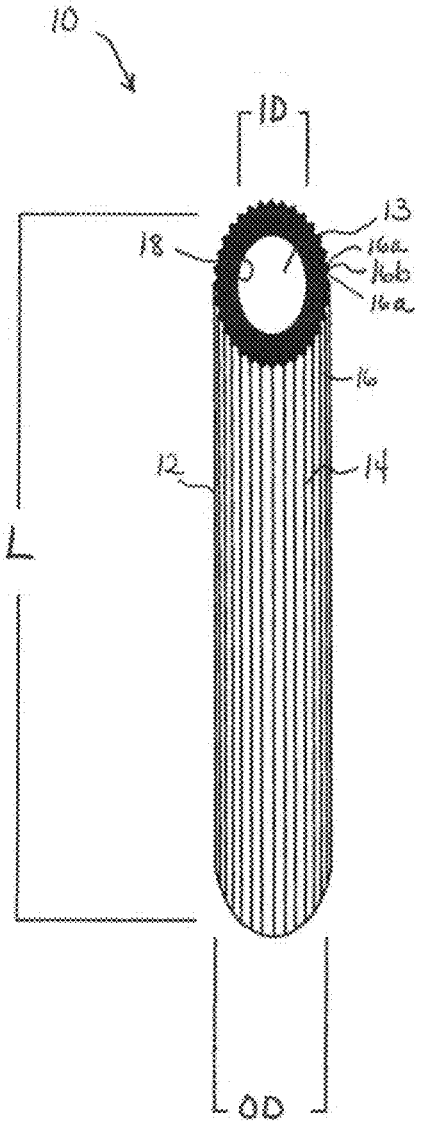
FIGS. 1A and 1B are front and side views, respectively, of a water noodle in accordance with an embodiment of the present disclosure.

Various exemplary embodiments of the present disclosure are discussed herein below in terms of pool noodles, assemblies, and methods of configuring and using the same. Although the structures are discussed as pool noodles and assemblies, it should be understood that the structures are not limited to use in a pool and may be utilized in any body of water.

Embodiments of the present disclosure will now be described in detail with reference to the drawing figures wherein like reference numerals identify similar or identical elements. Throughout this description, the term "user" refers to the person using the device and/or the person configuring the device for use. The terms "generally," "substantially," and "about" shall be understood as words of approximation that take into account relatively little to no variation in the modified terms (e.g., differing by less than 10%). In the following description, well-known functions or constructions are not described in detail to avoid obscuring the present disclosure in unnecessary detail.

Figure 1B:
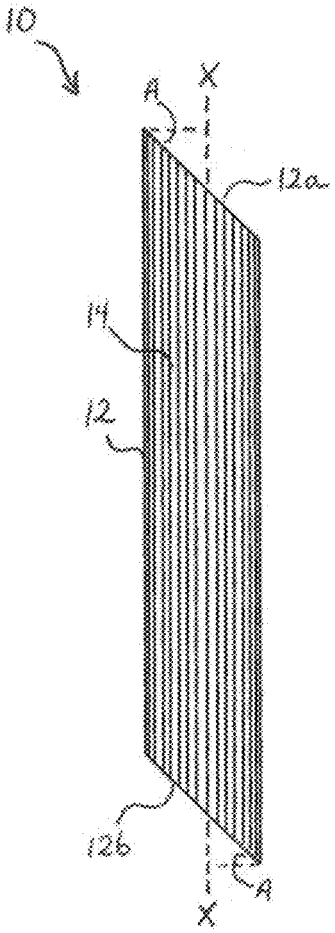

Referring now to FIGS. 1A and 1B, an exemplary floatation device in the form of a pool or water noodle 10 is shown. The water noodle 10 is called a "noodle" because its shape is similar to a pasta noodle. As seen in FIGS. 1A and 1B, the water noodle 10 is in the form of penne, however, other pasta noodle shapes and configurations (e.g., elbow macaroni) are envisioned.

The water noodle 10 is formed from a closed cell foam, such as polyethylene, that is sufficiently lightweight, flexible, and durable for repeated use in water. The water noodle 10 includes an elongated body 12 extending along a longitudinal axis "X." The elongated body 12 may be any suitable length "L" and may range, for example, from about 1 foot to about 6 feet. In embodiments, the elongated body 12 of the water noodle 10 is about 24 inches to about 48 inches in length "L" and, in some embodiments, is about 25 inches in length "L."

The elongate body 12 extends from a first end 12*a* to a second end 12*b*. The first and second ends 12*a*, 12*b* of the elongate body 12 are angled with respect to the longitudinal axis "X." The angle "A" of the first and second ends 12*a*, 12*b*, relative to the longitudinal axis "X", may range from about 30 degrees to about 60 degrees and, in some embodiments, the angle "A" of the first and second ends 12*a*, 12*b* is about 45 degrees. An angle "A" of about 45 degrees allows the water noodle 10 to be mated with another water noodle 10 at the first or second ends 12*a*, 12*b* thereof if such a configuration is desired (e.g., to form a longer water noodle 10, or an "L" shaped water noodle 10). In accordance with the present disclosure, first and second ends 12*a*, 12*b* are parallel to one another.

The elongated body 12 has a generally cylindrical shape and includes an outer surface 14 including a plurality of ridges or protrusions 16 extending therefrom and radially thereabout. The plurality of protrusions 16 extend longitudinally along the entire length "L" of the elongated body 12 in a uniform manner such that the outer diameter "OD" of the elongated body 12 is consistent along the length "L" thereof. Each of the plurality of protrusions 16 includes side walls 16*a* extending outwardly from the elongated body 12 that converge at a tip or point 16*b*. The point 16*b* may be v-shaped or c-shaped (e.g., rounded). While thirty-two points 16*b* are shown in FIG. 1A, it should be understood that the elongated body 12 may include any number of points 16*b* greater or less than thirty-two. It is further contemplated that the elongated body 12 may include no protrusions 16 (e.g., may include knurled or a relatively smooth outer surface).

The elongated body 12 defines a central bore 13 therethrough that is axially aligned with the longitudinal axis "X" and open at the first and second ends 12*a*, 12*b* of the elongated body 12. The central bore 13 is defined by an inner wall 18 of the elongated body 12 which, in turn, defines an inner diameter "ID" of the elongated body 12. The inner and outer diameters "ID," "OD" of the elongated body 12 may be of any suitable dimension. The inner diameter "ID" of the elongate body 12 may range from about 1 inch to about 4 inches, and the outer diameter "OD" of the elongate body may range from about 2 inches to about 5 inches. The ratio of the inner diameter "ID" to outer diameter "OD" may be about or greater than 0.7. In embodiments, the inner diameter "ID" of the elongated body 12 is about 2.5 inches and the outer diameter "OD" of the elongated body 12 is about 3.5 inches such that the ratio of ID:OD is about 0.71 and a wall thickness "T" of the elongate body 12 is about 0.5 inches.

While the elongated body 12 and the central bore 13 of the elongated body 12 are both shown as having a cylindrical shape, it should be understood that the elongated body 12 and the central bore 13 may have other shapes and/or may be different from each other.

Figure 2:
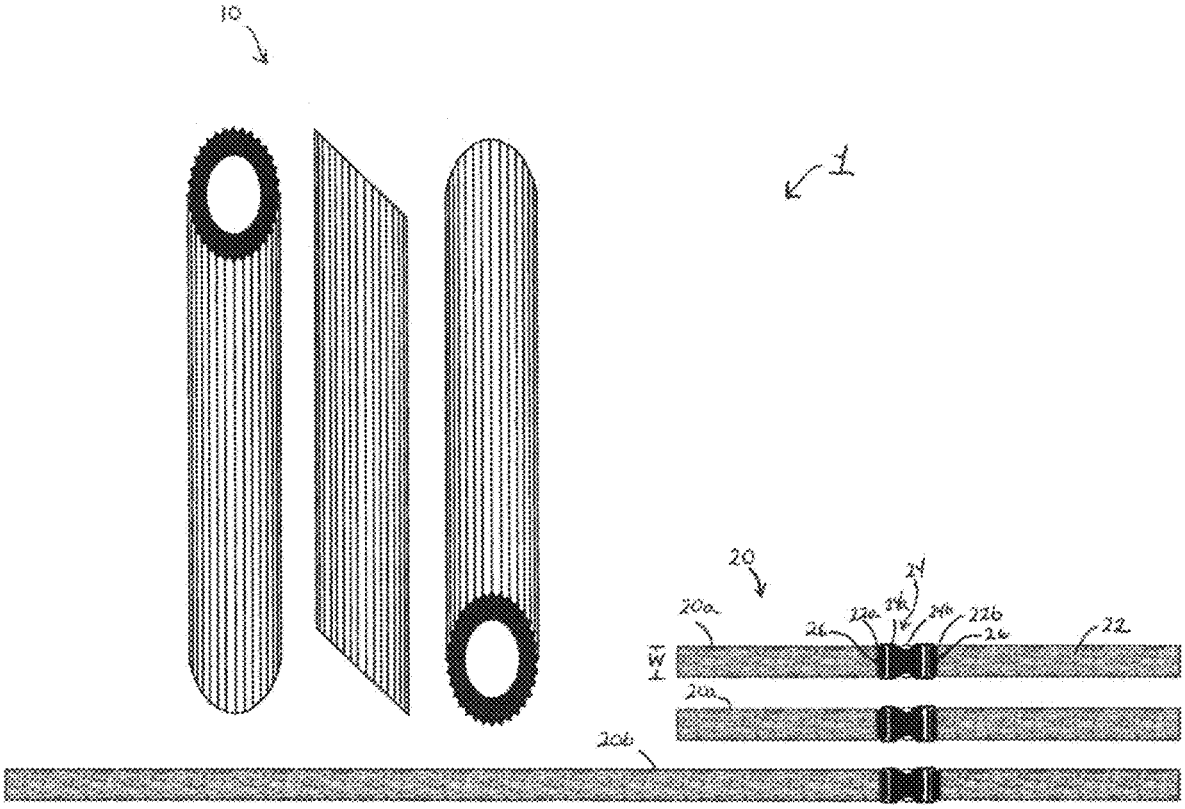
FIG. 2 is an orthogonal view of a water noodle system including water noodles and water noodle straps in accordance with an embodiment of the present disclosure.

With reference now to FIG. 2, a pool or water noodle system 1 is shown including three water noodles 10 and three water noodle straps 20 for forming a variety of water noodle assemblies, as described below. The three water noodles 10 may all be identical or may be different (e.g., in length, diameter, texture, etc.).

The water noodle straps 20 each includes an elongated strap body 22 terminating at first and second ends 22*a*, 22*b*, and first and second buckle portions 24*a*, 24*b* affixed to the respective first and second ends 22*a*, 22*b* of the elongated strap body 22. The elongated strap body 22 is formed from a flexible and/or elastic material, such as polypropylene, that is sufficiently strong and durable to maintain its integrity for repeated use in water.

Together the first and second buckle portions 24*a*, 24*b* form a quick connect/disconnect side release buckle 24 in which the first buckle or female portion 24*a* has two opposed openings 25 (FIG. 4) configured to receive two extensions 27 (FIG. 4) of the second buckle or male portion 24*b*. The first and second buckle portions 24*a*, 24*b* automatically lock in place when the extensions 27 of the second buckle portion 24*b* are inserted into the openings 25 of the first buckle portion 24*a*. The first and second buckle portions 24*a*, 24*b* are quickly unlocked by pressing the extensions 27 inwardly towards the center of the first buckle portion 24*a* and pulling the second buckle portion 24*b* away from the first buckle portion 24*a*. While the first and second buckle portions 24*a*, 24*b* are shown as forming a quick connect/disconnect side release buckle 24, it should be understood that other male/female mating connectors may be utilized to fasten the first and second ends 22*a*, 22*b* of the elongated strap body 22 together, such as pass through buckles or quick release buckles having a different configuration (e.g., a center release button).

The water noodle straps 20 may be any suitable length "E" (FIG. 7A) and may range, for example, from about 2 feet to about 10 feet. The water noodle straps 20 may all have the same length or may be different lengths, and the lengths may be fixed or adjustable. Further, the width "W"

of the water noodle straps 20 may be the same or different. In embodiments, the water noodle straps 20 include two short straps 20*a* which are about 24 inches in length "E", and one long strap 20*b* which is about 96 inches in length "E," and each of the short and long straps 20*a*, 20*b* is about 0.75 inches in width "W." Additionally, each of the water noodle straps 20 may include strap adjusters 26 (e.g., slip lock tension buckles) for individually adjusting the length "E" of the elongated strap body 22.

It should be understood that the length of the water noodle straps 20 provided in the water noodle system 1 is dependent upon the length(s) and diameter(s) of the water noodles 10 of the water noodle system 1, and/or the desired configuration of a water noodle assembly formed with components of the water noodle system 1. Further the width of the water noodle straps 20 may be dependent upon the size of the water noodles 10 and/or the inner diameter of the water noodles 10.

The water noodle system 1 may be utilized in a variety of configurations. The water noodles 10 may be utilized individually or collectively without the water noodle straps 20. For example, a water noodle 10 having a size of about 25 inches may be utilized individually by a child to float with, or collectively by an adult, such as one under each arm, to comfortably float. The water noodles 10 may also be utilized individually or collectively with the water noodle strap(s) 20 to form water noodle assemblies.

Figure 3:
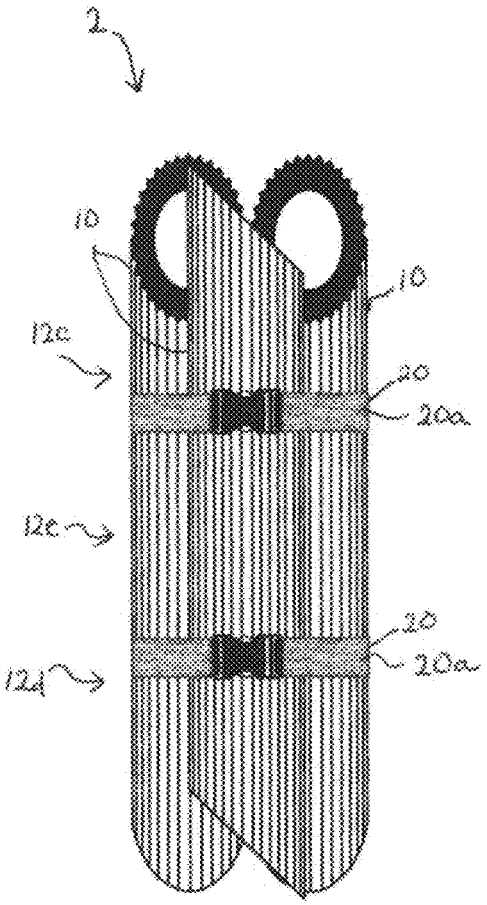
FIG. 3 is a top view of a water noodle assembly including components of the water noodle system of FIG. 2 in accordance with an embodiment of the present disclosure.

As shown in FIG. 3, a water noodle assembly 2 includes the three water noodles 10 and the two short straps 20*a* of the water noodle system 1. The water noodles 10 are secured together in a bundle utilizing the two short straps 20*a*. It should be understood that the number of water noodles 10 secured together may vary (e.g., two, three, four, or more), for example, to increase the buoyancy of the water noodle assembly 2. The number of straps 20 utilized may also vary. As shown, the short straps 20*a* are positioned about first and second end portions 12*c*, 12*d* of the water noodles 10. Alternatively, a single strap 20 (e.g., a single short strap 20*a* or a single long strap 20*b* (FIG. 2)) may be utilized about a central portion 12*e* of the water noodles 10 to secure the water noodles 10 together. In some embodiments, the plurality of protrusions 16 (FIG. 1) of the water noodles 10 are configured to mesh or interlock with each other to aid in the engagement of the water noodles 10 with each other when bundled together.

Figure 4:
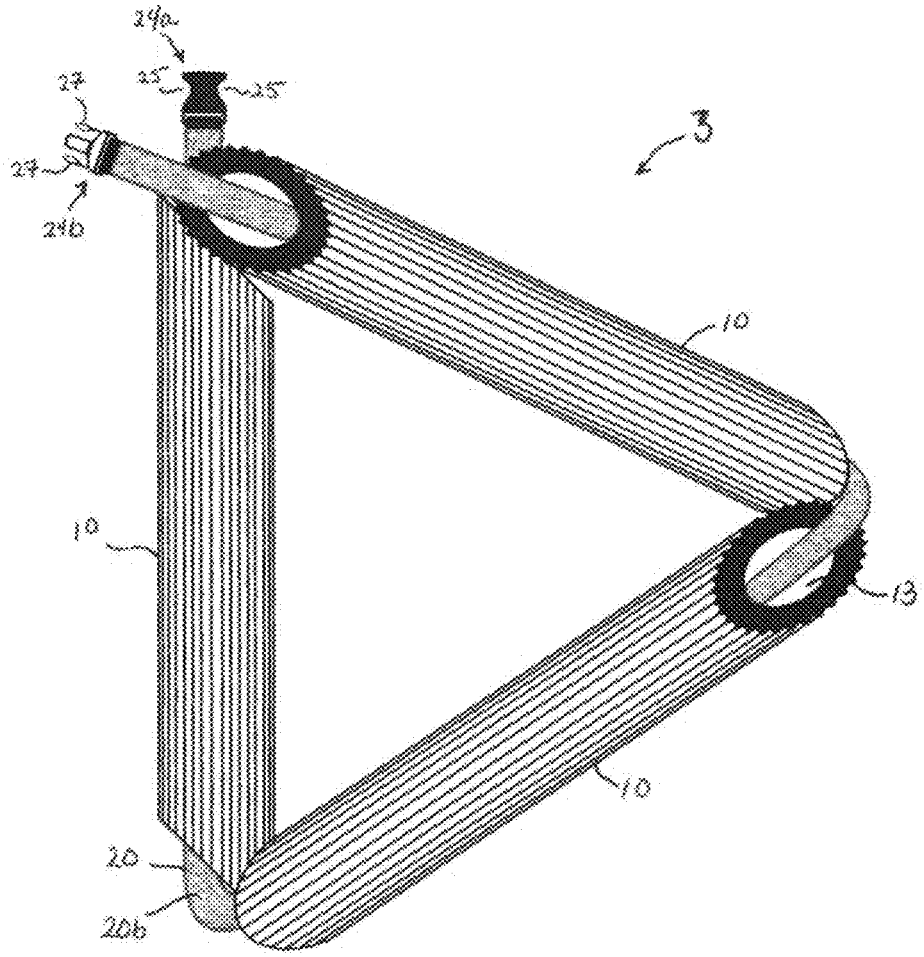
FIG. 4 is a top view of a water noodle assembly including components of the water noodle system of FIG. 2 in accordance with another embodiment of the present disclosure.

As shown in FIG. 4, a water noodle assembly 3 includes the three water noodles 10 and the long strap 20*b* of the water noodle system 1. The long strap 20*b* is passed through the central bores 13 of each of the water noodles 10 to create a noodle triangle, i.e., an enclosed structure. Depending upon the size of the water noodles 10, a user may pass their torso through the water noodle assembly 3 to keep afloat, or may lay their back, arms, and legs over the water noodle assembly 3 to utilize the water noodle assembly 3 as an inner tube or float. It should be understood that more than three water noodles 10 may be used and/or the water noodle straps 20 may be secured to one another to create a longer strap for use with the additional water noodles 10, to form a larger water noodle assembly, such as a noodle square or other noodle polygons.

Figure 5:
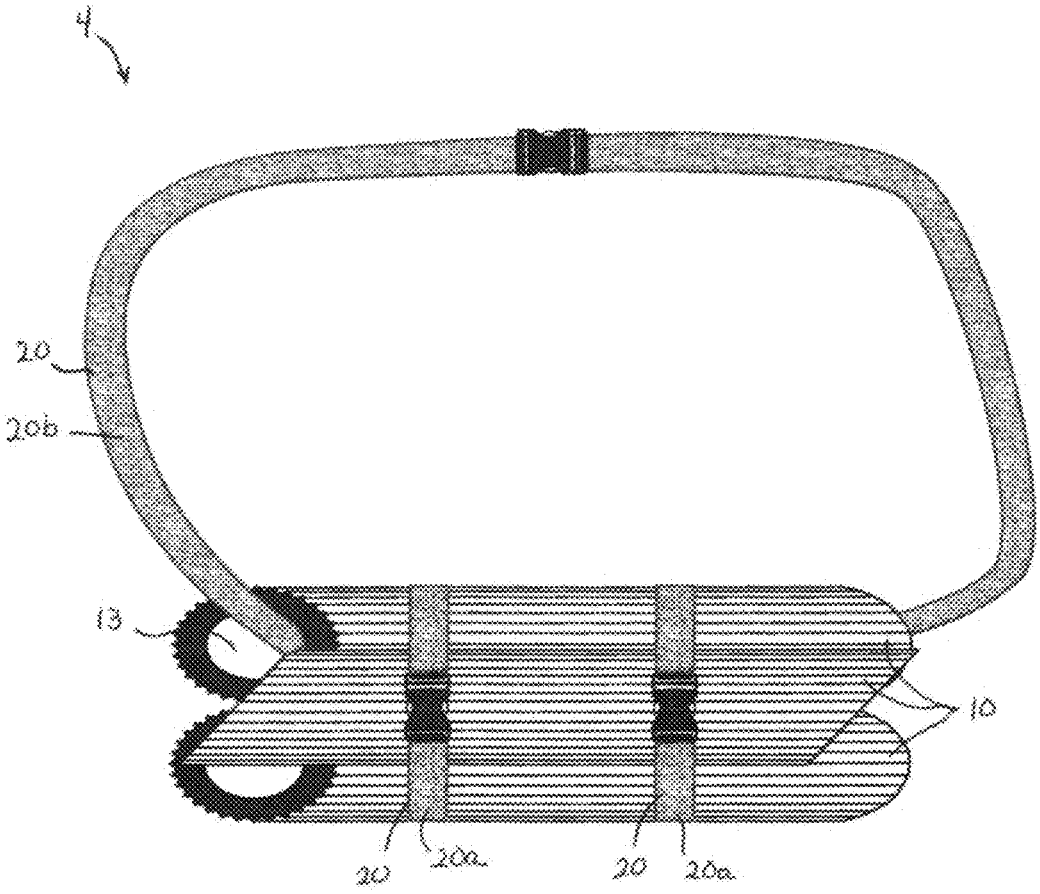
FIG. 5 is a top view of a water noodle assembly including components of the water noodle system of FIG. 2 in accordance with yet another embodiment of the present disclosure.

As shown in FIG. 5, a water noodle assembly 4 includes the three water noodles 10 and the three water noodle straps 20 of the water noodle system 1. The three water noodles 10 are secured together in a bundle utilizing the two short straps 20*a* as described above with regard to FIG. 3, and the long strap 20*b* is passed through the central bore 13 of one of the water noodles 10. The water noodle assembly 4 may be used to transport and/or store the water noodle system 1. The water noodle assembly 4 may also be used as floatation device with the long strap 20*b* utilized as a harness around the torso of a user to limit movement of the user relative to the water noodles 10.

As shown in FIGS. 6A-6D, water noodle caps 30 may be another component of the water noodle system 1 of FIG. 2. The water noodle system 1 may include at least one each of first and second caps 30*a*, 30*b*. Each of the first and second caps 30*a*, 30*b* includes a cap body 32 having a rounded outer surface 32*a*, a substantially flat inner surface 32*b*, and a connector 34 extending from the inner surface 32*b*. The first and second caps 30*a*, 30*b* differ by the type of connector 34 extending from the cap body 32. With reference to FIGS. 6A and 6D, cap bodies 32 of water noodle caps 30 may have a foreshortened or oval planar profile or footprint. It is contemplated that cap bodies 32 of water noodle caps 30 may have other planar profiles or footprints, e.g., circular, rectangular, etc.

As shown in FIG. 7A, the first cap 30*a* includes a first connector 34*a* that is the same in structure as the first buckle portion 24*a* of the water noodle strap 20 (i.e., has two opposed openings 35) such that the first cap 30*a* may be mated with the second buckle portion 24*b* of the water noodle strap 20, and the second cap 30*b* includes a second connector 34*b* that is the same in structure as the second buckle portion 24*b* of the water noodle strap 20 (i.e., has two extensions 37) such that the second cap 30*b* may be mated with the first buckle portion 24*a* of the water noodle strap 20.

As shown in FIG. 7B, the first and second caps 30*a*, 30*b* may be secured to the second and first buckle portions 24*b*, 24*a*, respectively, of the water noodle strap 20 such that the inner surfaces 32*b* of the first and second caps 30*a*, 30*b* are engageable in abutting relation with the first and second ends 12*a*, 12*b* of the water noodle 10 so that the water noodle strap 20 is retained within the water noodle 10. The water noodle caps 30 may be utilized, for example, to string together two or more water noodles 10 into a longer structure (e.g., three, four, five, or six water noodles 10 strung along long strap 20*b*) such that the first and second caps 30*a*, 30*b* prevent separation of the water noodles 10 (e.g., the water noodles 10 do not slide off the water noodle strap 20).

It should be understood that the pool noodle systems of the present disclosure may include more or fewer water noodles 10, water noodle straps 20, and/or water noodle caps 30 depending upon the desired end-use configuration for particular water noodle assemblies. Further, the water noodle systems may be provided in a kit or package including a desired number of water noodles 10, water noodle straps 20, and/or water noodle caps 30, of the same or different configurations.

Persons skilled in the art will understand that the systems, assemblies, devices, and methods specifically described herein and illustrated in the accompanying figures are non-limiting exemplary embodiments, and that the description, disclosure, and figures should be construed merely exemplary of particular embodiments. It is to be understood, therefore, that the disclosure is not limited to the precise embodiments described, and that various other changes and modifications may be effected by one skilled in the art without departing from the scope or spirit of the disclosure. Additionally, it is envisioned that the elements and features illustrated or described in connection with one exemplary embodiment may be combined with the elements and features of another exemplary embodiment without departing from the scope of the disclosure, and that such modifications and variations are also intended to be included within the scope of the disclosure. Accordingly, the subject matter of the disclosure is not to be limited by what has been particularly shown and described.

What is claimed is:

1. A water noodle system comprising:

three water noodles, each of the water noodles having an elongated body extending along a longitudinal axis and terminating at first and second ends, the first and second ends of each of the water noodles being disposed at an acute angle with respect to the longitudinal axis of the elongated body, the elongated body defining a central bore therethrough that is axially aligned with the longitudinal axis, and an outer surface of the elongated body includes a plurality of protrusions extending therefrom and radially therearound, each of the plurality of protrusions including side walls tapering outwardly from the elongated body and converging at a point;

at least two water noodle straps, each of the water noodle straps having an elongated strap body terminating at first and second ends, and first and second buckle portions affixed to the respective first and second ends of the elongated strap body, the first and second buckle portions configured to mate with each other; and at least two water noodle caps, each of the water noodle caps including a cap body and a connector extending from an inner surface of the cap body, the connector configured to mate with the first or second buckle portion of the water noodle straps.

2. The water noodle system according to claim 1, wherein the angle of each of the first and second ends is about 45 degrees.

3. The water noodle system according to claim 1, wherein the plurality of protrusions extend longitudinally along an entire length of the elongated body in a uniform manner.

4. The water noodle system according to claim 1, wherein each of the water noodles includes thirty-two points.

5. The water noodle system according to claim 1, wherein each of the water noodles includes an outer diameter defined by the outer surface of the elongated body and an inner diameter defined by an inner wall of the elongated body, and a ratio of the inner diameter to the outer diameter is about or greater than 0.7.

6. The water noodle system according to claim 1, wherein the water noodle straps have different lengths.

7. The water noodle system according to claim 1, wherein each of the water noodle straps includes a strap adjuster.

8. The water noodle system according to claim 1, wherein the water noodle caps have an oval footprint.

9. The water noodle system according to claim 1, wherein the three water noodles are bundled together with at least one of the water noodle straps secured around the outer surfaces of the water noodles to form a water noodle assembly.

10. The water noodle system according to claim 9, wherein one of the water noodle straps is passed through the central bore of one of the water noodles.

11. The water noodle system according to claim 1, wherein one of the water noodle straps is passed through the central bore of each of the water noodles and the first and second buckle portions of the water noodle strap is locked together to form a water noodle triangle.

12. A water noodle comprising an elongated body extending along a longitudinal axis and terminating at first and second ends, each of the first and second ends disposed at an acute angle with respect to the longitudinal axis of the elongated body, the elongated body defining a central bore therethrough that is axially aligned with the longitudinal axis, an outer surface of the elongated body including a plurality of protrusions extending therefrom and radially therearound, each of the plurality of protrusions including side walls tapering continuously and outwardly from the outer surface of the elongated body and converging at a point to define non-interlocking ridges, wherein the water noodle is fabricated from a closed cell foam.

13. The water noodle according to claim 12, wherein the plurality of protrusions extending longitudinally along an entire length of the elongated body in a uniform manner.

14. The water noodle according to claim 12, wherein the first and second ends are parallel to one another.

15. A water noodle comprising an elongated body extending along a longitudinal axis and terminating at first and second ends, the first and second ends disposed at acute angles with respect to the longitudinal axis of the elongated body and define respective first and second beveled planar surfaces, the elongated body defining a central bore therethrough that is axially aligned with the longitudinal axis, an outer surface of the elongated body including a plurality of protrusions extending therefrom and radially therearound, each of the plurality of protrusions including side walls tapering outwardly from the elongated body and converging at a point, wherein the water noodle is fabricated from a closed cell foam.

16. The water noodle system according to claim 1, wherein the first and second ends of each of the water noodles are parallel to one another.

17. The water noodle system according to claim 1, wherein the sidewalls of each of the plurality of protrusions taper continuously from the outer surface of the elongated body to the point to define non-interlocking ridges.

18. The water noodle system according to claim 1, wherein the first and second ends of each of the water noodles define respective first and second beveled planar surfaces.

* * * * *